US007802665B2

(12) United States Patent
Tong

(10) Patent No.: US 7,802,665 B2
(45) Date of Patent: Sep. 28, 2010

(54) ROTATION-CONTROLLABLE ROTARY GRIP ASSEMBLY FOR LUGGAGE HANDLE

(76) Inventor: Joy Tong, 2932 NW. 27th St., Bldg. 14, Ft. Lauderdale, FL (US) 33311

( * ) Notice: Subject to any disclaimer, the term of this patent is extended or adjusted under 35 U.S.C. 154(b) by 608 days.

(21) Appl. No.: 11/905,214

(22) Filed: Sep. 28, 2007

(65) Prior Publication Data

US 2009/0084648 A1 Apr. 2, 2009

(51) Int. Cl.
*A47B 95/02* (2006.01)

(52) U.S. Cl. ..... 190/115; 16/113.1; 16/430

(58) Field of Classification Search ..... 190/115; 16/113.1, 430, 405; 280/655
See application file for complete search history.

(56) References Cited

U.S. PATENT DOCUMENTS 3,562,849 A * 2/1971 Brayshaw ..... 16/445
4,544,050 A * 10/1985 Seynhaeve ..... 190/115
5,371,923 A * 12/1994 Chang ..... 16/113.1
5,553,350 A * 9/1996 Chang ..... 16/113.1
5,970,579 A * 10/1999 Lu ..... 16/405
6,397,436 B1 * 6/2002 Wang ..... 16/445
6,467,130 B2 * 10/2002 Kurachi et al. ..... 16/438
2006/0130275 A1 * 6/2006 Tong ..... 16/113.1

* cited by examiner

*Primary Examiner*—Tri M Mai
(74) *Attorney, Agent, or Firm*—Bacon & Thomas, PLLC

(57) ABSTRACT

A rotation-controllable rotary grip assembly includes a shaft affixed to a retractable handle of a luggage, a barrel-like grip sleeved onto and turntable about the shaft, a spring member sleeved onto one extension rod at one end of the shaft and connected between the shaft and the grip for returning the grip to its former position after a rotary motion of the grip relative to the shaft, and a lock for locking the grip to the shaft to prohibit rotation of the grip relative to the shaft.

6 Claims, 6 Drawing Sheets

ROTATION-CONTROLLABLE ROTARY GRIP ASSEMBLY FOR LUGGAGE HANDLE

BACKGROUND OF THE INVENTION (a) Field of the Invention

The present invention relates to a luggage handle and more specifically, to a rotation-controllable rotary grip assembly for use in a retractable handle of a luggage.

(b) Description of the Prior Art

A regular luggage (travel bag), more particularly, a wheeled luggage (travel bag) has a retractable handle for carrying by hand. The retractable handle of a luggage (travel bag) has a grip for the grasping of the hand. When the luggage (travel bag) is standing still on the floor, the retractable handle is kept in vertical. Before moving the luggage (travel bag) on the floor, the user must extend out retractable handle and hold the retractable handle and the luggage (travel bag) in a tilted position. When adjusting the luggage (travel bag) between the vertical position and the tilted position, the user must keep the hand grasping the grip of the retractable handle in a loosened status, preventing heavy friction between the palm of the hand and the grip of the retractable handle or twisting of the hand. Further, when the luggage (travel bag) is moving over an uneven floor surface or when the user vibrating the body during walking, the hand must be kept in a loosened status to prevent an injury. However, the grip may rub against the skin of the palm of the hand heavily when the hand is kept in a loosened status. In order to eliminate this problem, EP0548708A1 discloses a grip structure, entitled "Handle, particularly for portfolios, suitcases, briefcases, or similar". According to this design, the anatomic grip of the handle is able to rotate or to oscillate about a longitudinal axis and elastic means are provided which return the grip to a rest position when it is released by the user's hand, so that this grip may always be grasped correctly, without having to be orientated about the said axis of rotation or oscillation for this purpose. According to this design, the grip will deviate from the position when rotated. When pulling the handle during walking, the grip may be not kept in balance, affecting the pulling action.

SUMMARY OF THE INVENTION

The present invention has been accomplished under the circumstances in view. It is the main object of the present invention to provide a rotation-controllable rotary grip assembly, which keeps the grip in balance when the grip is rotated relative to the handle of the luggage, so that the user can pull the handle smoothly with less effort.

To achieve this and other objects of the present invention, the rotation-controllable rotary grip assembly is comprised of a shaft affixed to a retractable handle of a luggage, a barrel-like grip rotatably sleeved onto said shaft, a spiral torsion spring sleeved onto said shaft and connected between the shaft and the grip for reversing the grip after each rotary motion of the grip relative to the shaft, and a lock for locking the grip to the shaft. The shaft comprises a locating means at its one end, namely, the first end. The grip comprises an axial hole axially extending through first and second ends thereof and coupled to the shaft for allowing rotation of the grip relative to the shaft, a locating means on the first end, and a recessed hole on the second end. The spiral torsion spring has a first pin extending from one end thereof and fastened to the locating means of the shaft, and a second pin extending from an opposite end thereof and fastened to the locating means of the grip. The lock comprises a latch mounted in the retractable handle of the luggage and movable between a locking position where the latch locks the grip to the shaft and an unlocking position wherein the latch unlocks the grip from the shaft for allowing rotation of the grip relative to the shaft. The latch comprises a base, a first top groove and a second top groove formed on the top side of the base, a finger strip extending from the bottom side of the base for operating by hand to move the latch between the locking position and the unlocking position, a latch pin extending from the front side of the base for engaging the recessed hole of the grip to lock the grip to the shaft, a positioning member selectively positioning in one of the first top groove and the second top groove, and a spring member pressed on the positioning member to hold the positioning member in one of the first top groove and the second top groove.

DETAILED DESCRIPTION OF THE PREFERRED EMBODIMENTS

Figure 1:
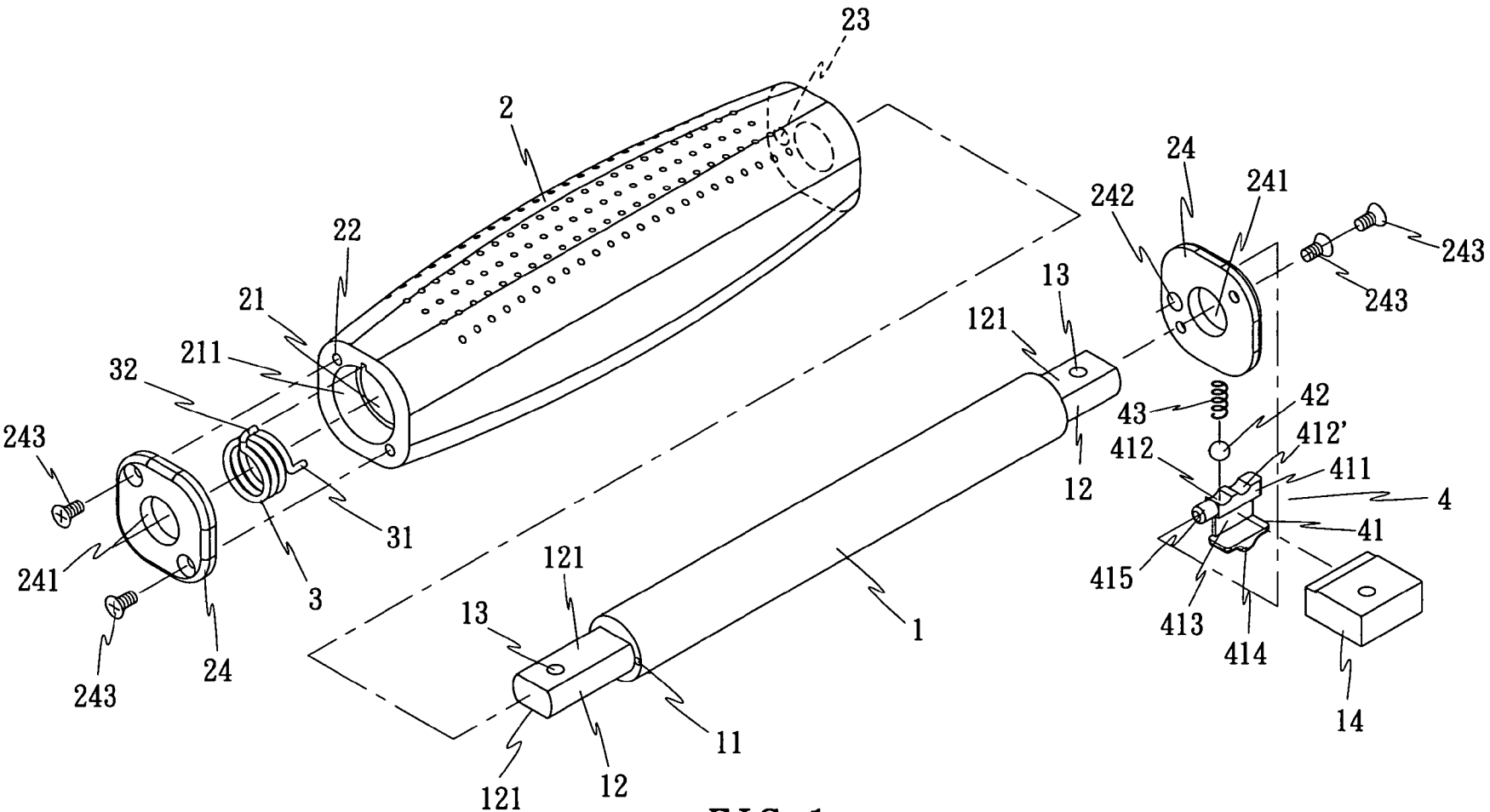
FIG. 1 is an exploded view of a rotation-controllable rotary grip assembly in accordance with the present invention.

Referring to FIG. 1, a rotation-controllable rotary grip assembly in accordance with the present invention is shown comprised of a shaft 1, a grip 2, a spring member 3, and a lock 4.

Figure 2:
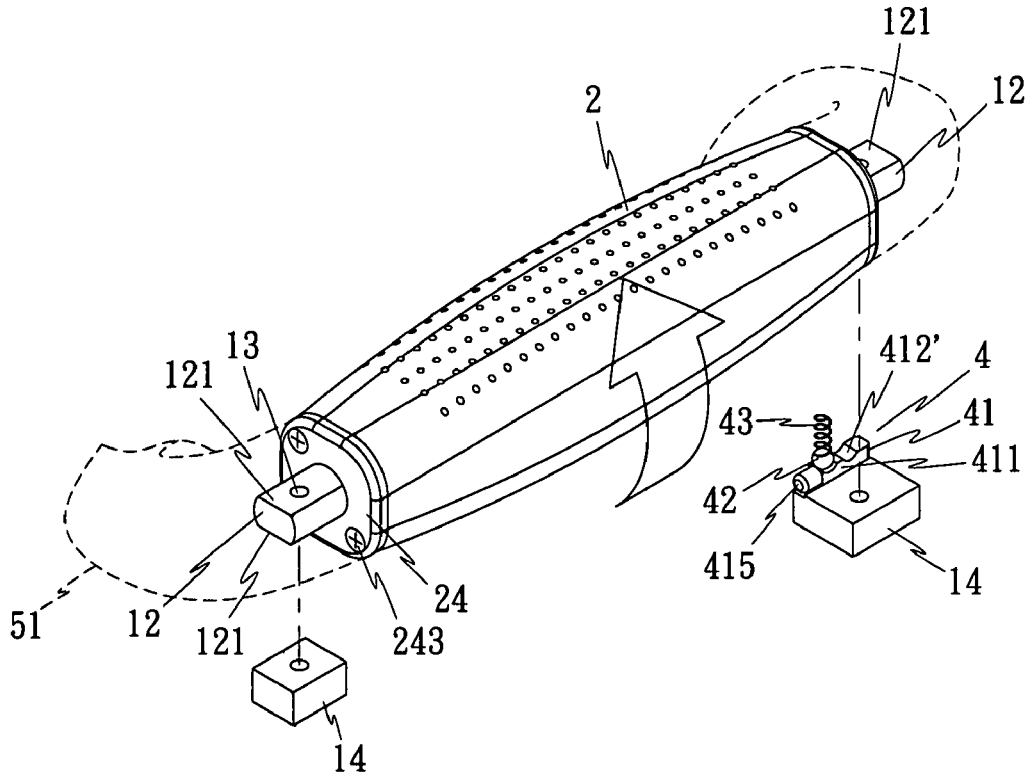
FIG. 2 is a schematic perspective view of the rotation-controllable rotary grip assembly in accordance with the present invention, showing the lock assembled before installation.
Figure 3:
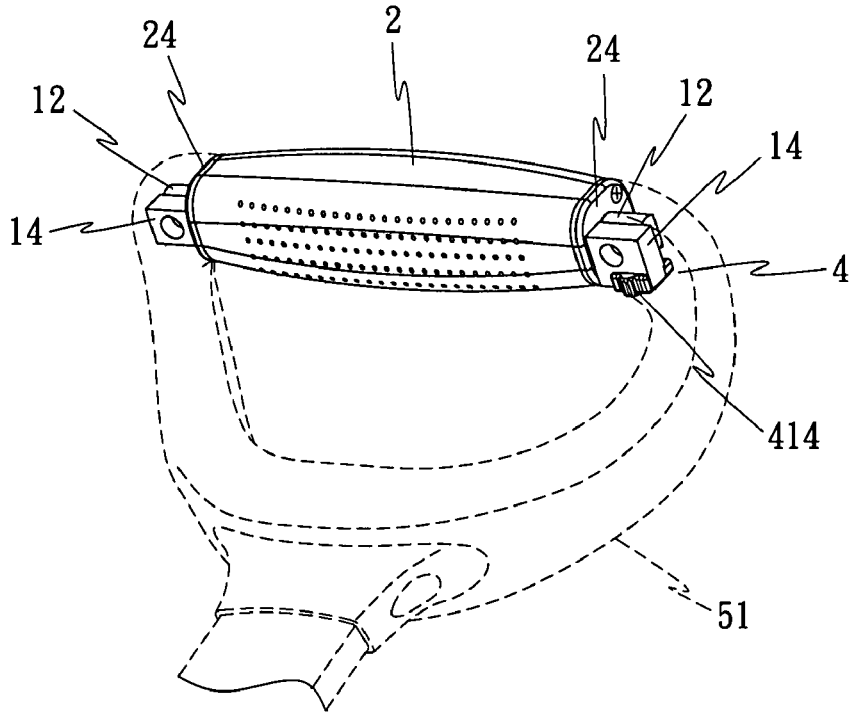
FIG. 3 is a perspective assembly view of the rotation-controllable rotary grip assembly in accordance with the present invention.
Figure 4:
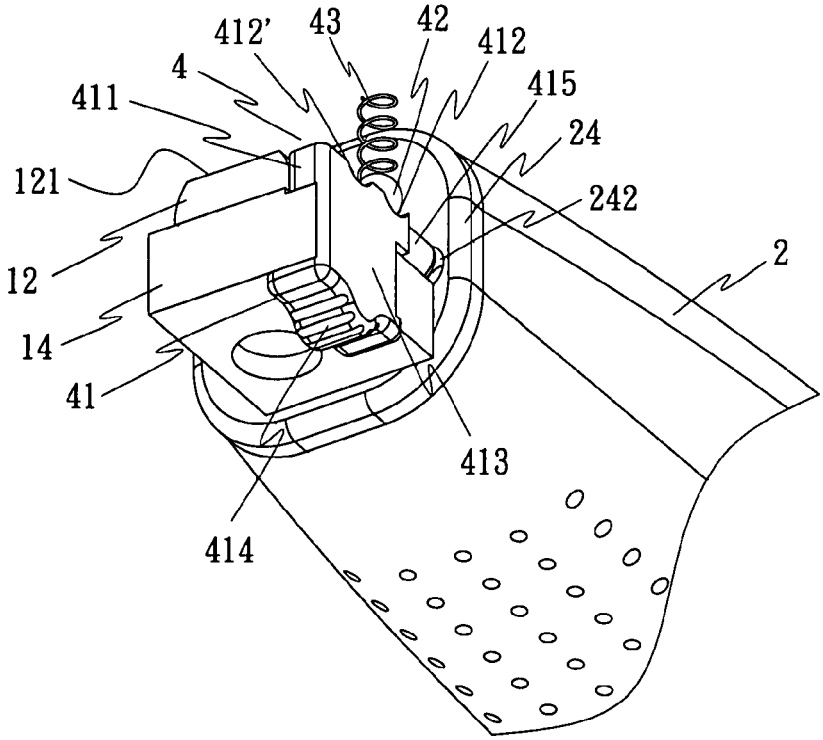
FIG. 4 is an elevational view in an enlarged view of one end of the rotation-controllable rotary grip assembly in accordance with the present invention, showing the positioning of the lock.

Referring to FIGS. 2 and 3 and FIG. 1 again, the shaft 1 comprises a locating means, for example, a locating hole 11 on its one end, and two extension rods 12 respectively and axially extending from its two opposite ends. The extension rods 12 each have at least one, for example two planes 121, and a mounting hole 13 cut through the planes 121. Further, a locating block 14 is respectively attached to one plane 121 of each of the extension rods 12. By means of the mounting holes 13 of the extension rods 12 and the locating blocks 14, the shaft 1 is fastened to a handle 51 of a luggage 5 (see also FIG. 10).

Referring to FIG. 1 again, the grip 2 is shaped like a barrel, having an axial hole 21 axially extending through its two distal ends and coupled to the shaft 1 for allowing turning of the grip 2 about the shaft 1, a locating means, for example, a locating groove 22 on its first end, an end recess 211 formed on the first end around the axial hole 21, and a recessed hole 23 on its second end. The locating groove 22 is axially formed on the first end of the grip 2 and abutted to the border of the end recess 211. Further, two end plates 24 are respectively fastened to the first and second ends of the grip 2 with screws 243. One end plate 24 has a first through hole 241 and a second through hole 242 respectively aligned with the axial hole 21 and recessed hole 23 of the grip 2. The first through hole 241 has a diameter fitting the outer diameter of the extension rods 12 of the shaft 1. After installation of the end plates 24, the grip 2 is secured to the shaft 1 and prohibited from axial displacement relative to the shaft 1.

Figure 5:
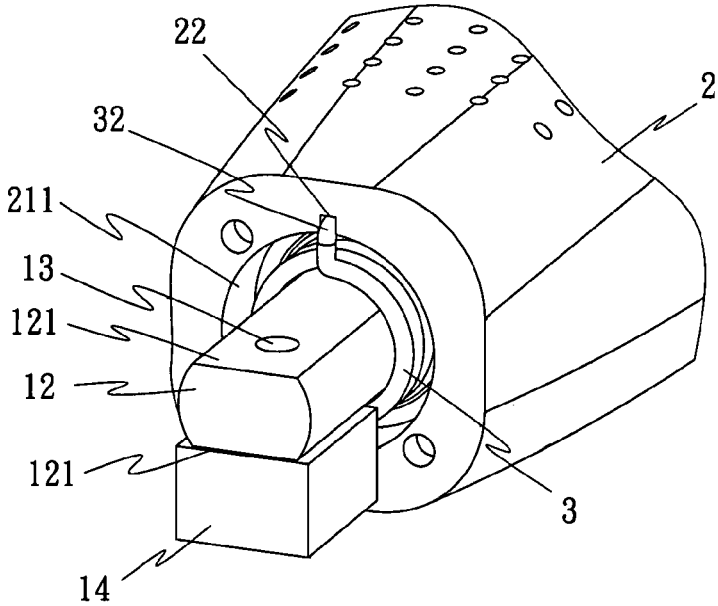
FIG. 5 is an elevational view in an enlarged view of the other end of the rotation-controllable rotary grip assembly in accordance with the present invention, showing the positioning of the spring member.
Figure 6:
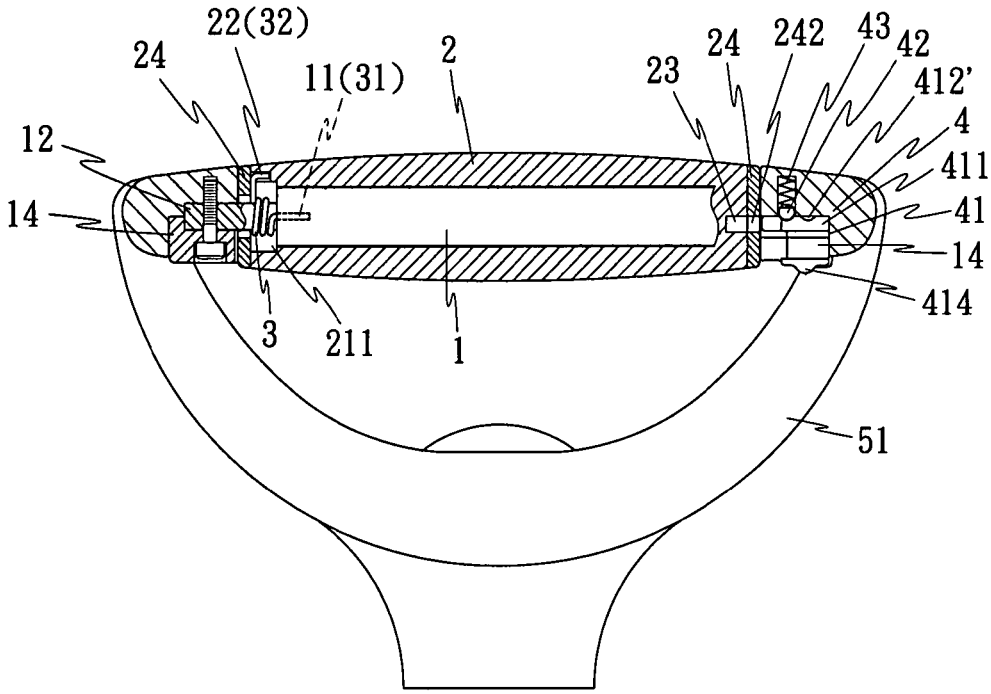
FIG. 6 is a schematic sectional view of the present invention, showing the latch engaged into the recessed hole of the grip.

Referring to FIGS. 5 and 6 and FIG. 1 again, the spring member 3 is a spiral torsion spring sleeved onto the shaft 1 and received in the end groove 211 of the grip 2, having a first end terminating in a first pin 31 that is fastened to the locating hole 11 of the shaft 1 and a second end terminating a second pin 32 that is fastened to the locating groove 22 (see FIGS. 5 and 6). When rotating the grip 2 relative to the shaft 1, the spring member 3 is compressed. When released the hand from the grip 2 after rotation, the spring force of the spring member 3 immediately reverses the grip 2 relative to the shaft 1 to its former position.

Referring to FIG. 4 and FIGS. 1~3 again, the lock 4 is comprised of a latch 41, a positioning member 42, and a spring 43. The latch 41 is mounted in the handle 51 adjacent to the recessed hole 23 of the grip 2 and slidable toward and away from the recessed hole 23. The latch 41 has a base 411, a first top groove 412 and a second top groove 412' on the top side of the base 411, a L-shaped guide plate 413 disposed at the bottom side of the base 411 and slidably coupled to the associating end plate 14, a finger rod 414 extending from the guide plate 413, and a latch pin 415 extending from the base 411 for engaging the recessed hole 23 of the grip 2 to stop the grip 2 from rotation relative to the shaft 1. The positioning member 42 is a steel ball selectively set in the first top groove 412 or second top groove 412' on the top side of the base 411 to hold down the latch 41 in one of two positions, namely, the locking position where the latch pin 415 is engaged into the recessed hole 23 and the unlocking position where the latch pin 415 is disengaged from the recessed hole 23. The spring 43 is a compression spring pressed on the steel ball 42 to hold the steel ball 42 in the first top groove 412 or second top groove 412'.

Figure 10:
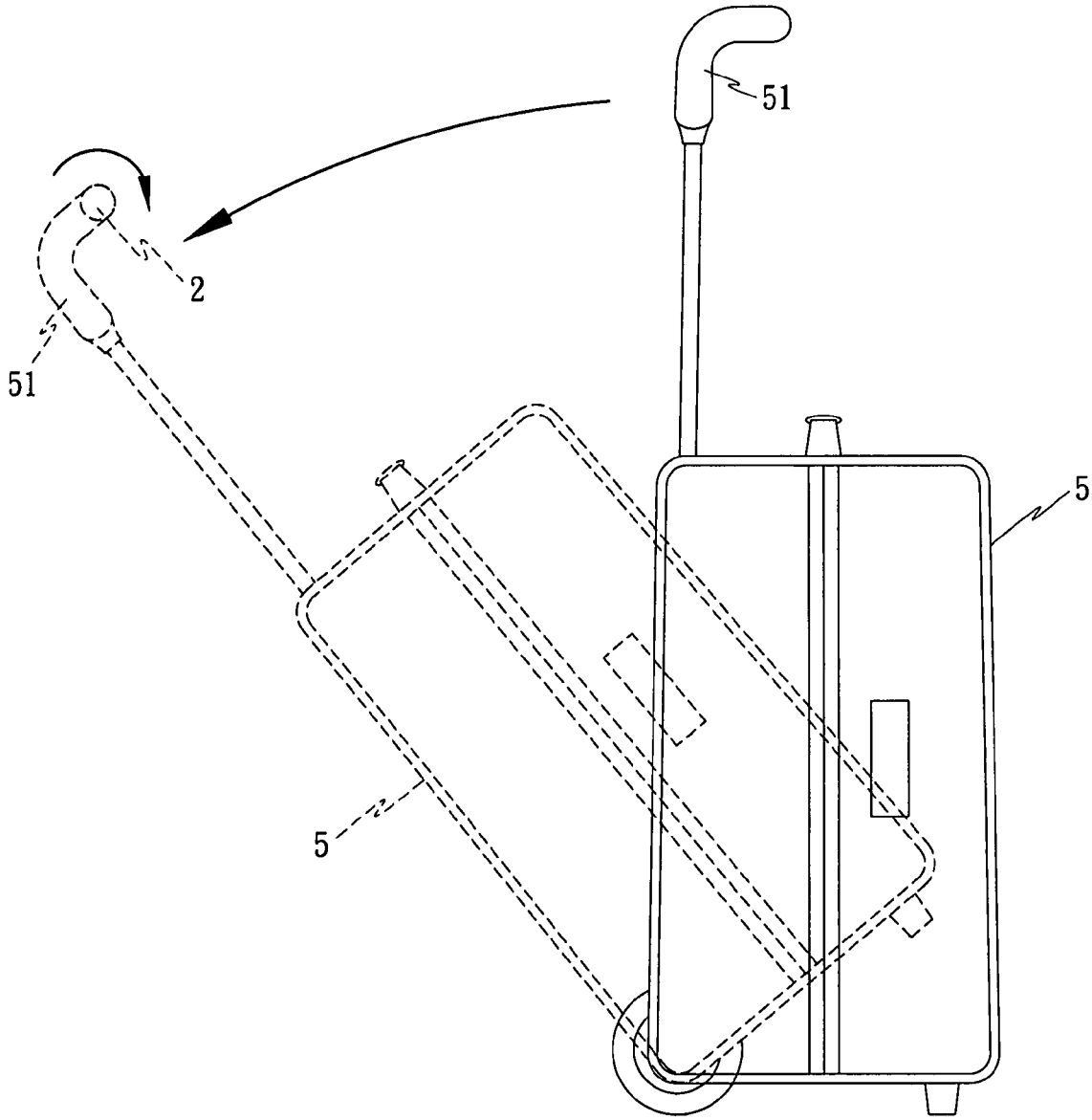
FIG. 10 is a schematic applied view of the present invention, showing the rotation-controllable rotary grip assembly installed in the handle of a luggage and operated.

Referring to FIGS. 6 and 10, when the shaft 1, the grip 2, the spring member 3 and the lock 4 are assembled, the rotation-controllable rotary grip assembly is installed in (the forked top end of) the handle 51 of the luggage 5. After installation of the rotation-controllable rotary grip assembly in the handle 51, the shaft 1 is fixedly secured to the handle 51 and prohibited from rotation relative to the handle 51, and the user can control the lock 4 to lock or unlock the grip 2.

Figure 7:
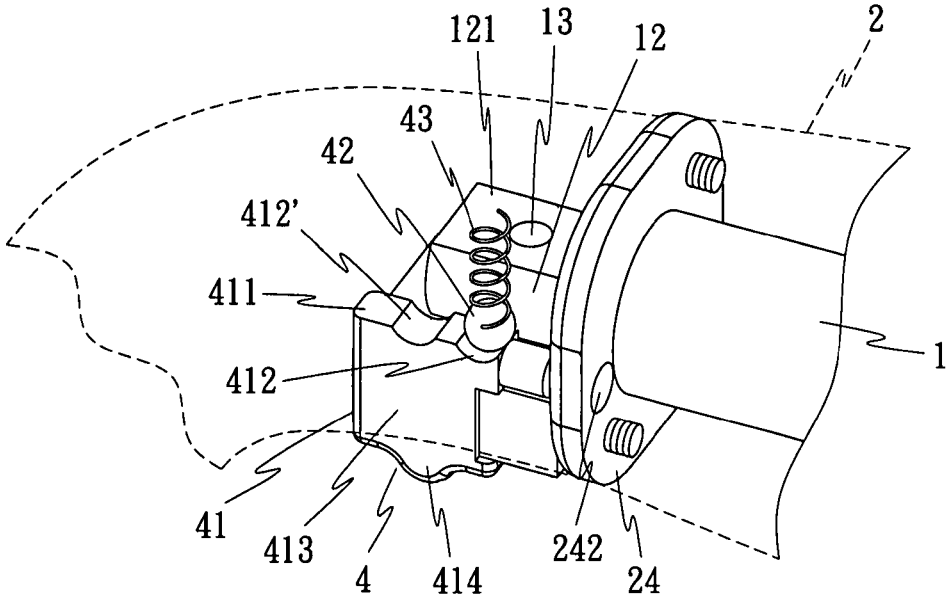
FIG. 7 is a schematic perspective view of a part of the present invention, showing the latch engaged into the recessed hole of the grip.

Referring to FIGS. 6 and 7, when the user pulled the latch 41 outwards to have the steel ball 42 be positioned in the first top groove 412, the latch pin 415 is disengaged from the recessed hole 23 of the grip 2 and the second through hole 242 of the associating end plate 24, the grip 2 is turnable about the shaft 1 in one direction. When the user holds the grip 2 of the rotation-controllable rotary grip assembly with the hand to pull the luggage 5 (see FIG. 10), the luggage 5 and the handle 51 are tilted, and at the same time the grip 2 is turned about the shaft 1 through an angle to fit the tilting action of the luggage 5 and the handle 51. When moving over an uneven floor or road surface, the grip 2 is turned about the shaft 1 alternatively forwards and backwards to eliminate shocks. Therefore, the user can carry the luggage 5 comfortably with less effort when walking.

Figure 8:
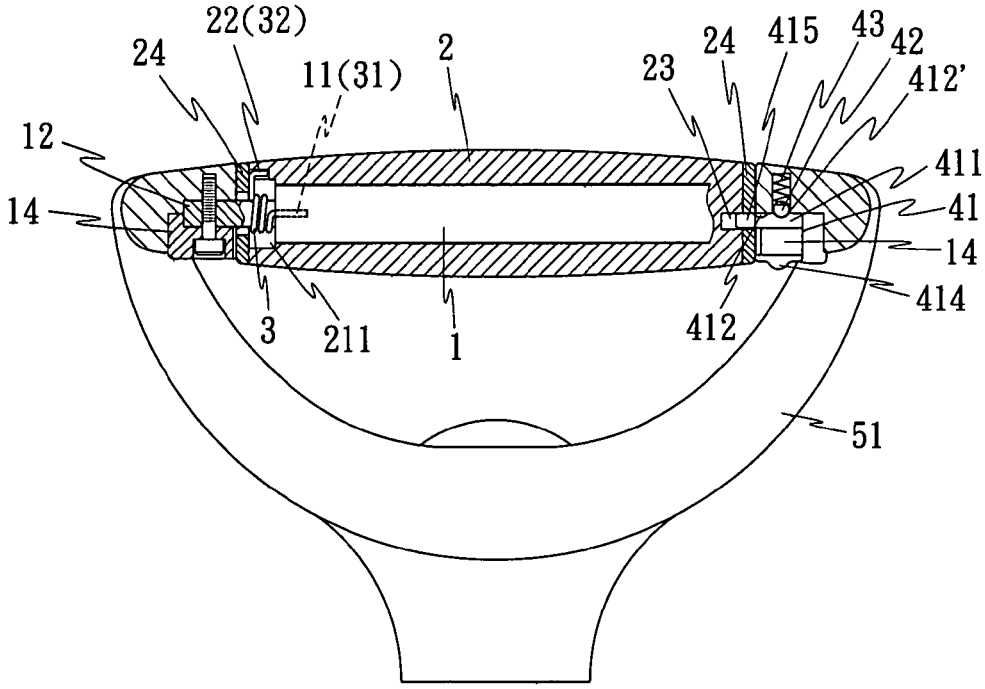
FIG. 8 is a schematic sectional view of the present invention, showing the latch disengaged from the recessed hole of the grip.
Figure 9:
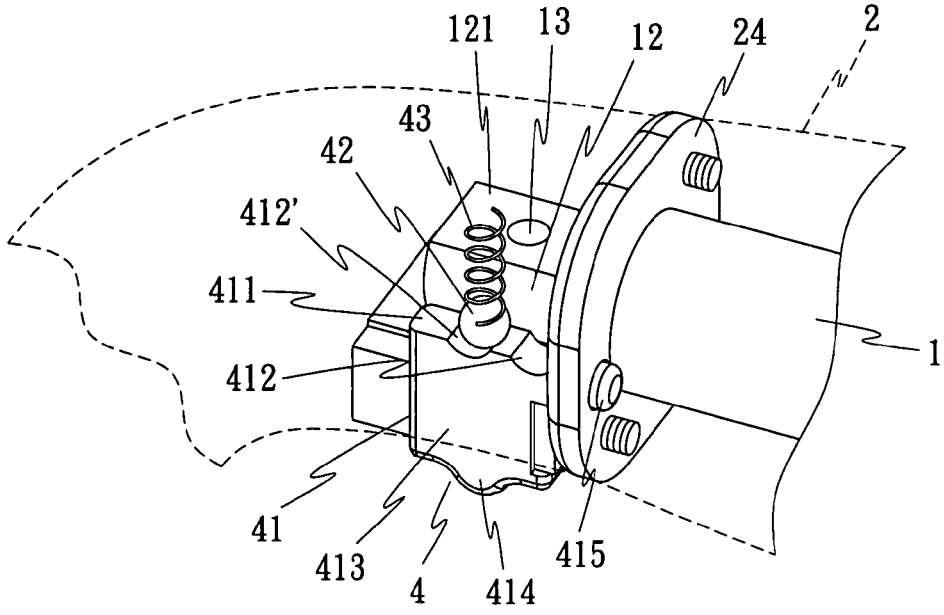
FIG. 9 is a schematic perspective view of a part of the present invention, showing the latch disengaged from the recessed hole of the grip.

Referring to FIGS. 8 and 9, when the user pushes the latch 41 of the lock 4 forwards to have the steel ball 42 be positioned in the second top groove 412', the latch pin 415 is engaged into the recessed hole 23 of the grip 2 and the second through hole 242 of the associating end plate 24 to lock the grip 2, prohibiting the grip 2 from rotary motion relative to the shaft.

As stated above, the rotation-controllable rotary grip assembly allows the user to lock or unlock the grip 2. When the grip 2 is locked, it is prohibited from rotary motion relative to the shaft 1. On the contrary, when the grip 2 is unlocked, the grip 2 is turnable about the shaft 1. During rotation of the grip 2 relative to the shaft 1, the grip 2 is kept in balance, and will not deviate from the position, i.e., the invention eliminates the drawback of the prior art EP0548708A1.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotation-controllable rotary grip assembly, comprising:

a shaft affixed to a retractable handle of a luggage, said shaft comprising a first end, a second end, and a locating means at the first end;

a grip shaped like a barrel and rotatably sleeved onto said shaft, said grip comprising an axial hole axially extending through first and second ends thereof and coupled to said shaft for allowing rotation of said grip relative to said shaft, a locating means on the first end, and a recessed hole on the second end;

a spiral torsion spring sleeved onto said shaft, said spiral torsion spring having a first pin extending from one end thereof and fastened to the locating means of said shaft and a second pin extending from an opposite end thereof and fastened to the locating means of said grip; and a lock for locking said grip to said shaft to prohibit rotary motion of said grip relative to said shaft, said lock comprising a latch mounted in said retractable handle of said luggage and movable between a locking position where said latch locks said grip to said shaft and an unlocking position wherein said latch unlocks said grip from said shaft for allowing rotation of said grip relative to said shaft, said latch comprising a base, a first top groove and a second top groove formed on a top side of said base, a finger strip extending from a bottom side of said base for operating by hand to move said latch between said locking position and said unlocking position, a latch pin extending from a front side of said base for engaging the recessed hole of said grip to lock said grip to said shaft, a positioning member selectively positioning in one of said first top groove and said second top groove, and a spring member pressed on said positioning member to hold said positioning member in one of said first top groove and said second top groove.

2. The rotation-controllable rotary grip assembly as claimed in claim 1, wherein the locating means of said shaft is a locating hole formed on the first end of said shaft; said grip further comprises an end recess formed on the first end of said grip around said axial hole; the locating means of said grip is a locating groove disposed in said end recess; said spiral torsion spring is mounted on said shaft and received in said end recess of said grip to have said first pin fastened to the locating hole of said shaft and said second pin fastened to the locating groove of said grip.

3. The rotation-controllable rotary grip assembly as claimed in claim 1, wherein said shaft comprises two extension rods respectively axially extending from the first end and second end thereof, said extension rods each having at least one plane and a mounting hole transverse cut through said at least one plane, and two locating blocks respectively attached to one plane of each of said extension rods for fixation with the mounting holes of said extension rods to said retractable handle of said luggage for guiding movement of said latch between said locking position and said unlocking position.

4. The rotation-controllable rotary grip assembly as claimed in claim 3, further comprising two end plates respectively mounted on said extension rods of said shaft and affixed to the first and second ends of said grip, said end plates each having a first through hole disposed in alignment with the axial hole of said grip for the passing of said extension rods of said shaft respectively, one said end plate having a second through hole disposed in alignment with the recessed hole of said grip.

5. The rotation-controllable rotary grip assembly as claimed in claim 1, wherein said latch further comprises a L-shaped guide plate connected between said base and said finger strip for guiding movement of said latch relative to said shaft between said locking position and said unlocking position.

6. The rotation-controllable rotary grip assembly as claimed in claim 1, wherein said positioning member is a steel ball selectively positioned in one of said first top groove and said second top groove.

* * * * *